United States Patent [19]

Martin Cocher et al.

[11] Patent Number: 4,831,812

[45] Date of Patent: May 23, 1989

[54] PROCESS AND APPARATUS FOR PASS-THROUGH WRAPPING

[75] Inventors: Jean P. C. Martin Cocher, La Motte Servolex; Alain J. L. Velletaz, Drumetaz-Clarafond, both of France

[73] Assignee: Newtec International, Aux Les Bains, France

[21] Appl. No.: 119,901

[22] Filed: Nov. 10, 1987

[30] Foreign Application Priority Data

Nov. 12, 1986 [FR] France ..... 86 15709

[51] Int. Cl.[4] ..... B65B 11/08

[52] U.S. Cl. ..... 53/399; 53/441; 53/466; 53/556; 53/586; 53/449; 53/176

[58] Field of Search ..... 53/399, 441, 466, 556, 53/586, 229, 449, 176

[56] References Cited

U.S. PATENT DOCUMENTS

| | | | |
|---|---|---|---|
| 3,884,016 | 5/1975 | Bustrom | 53/229 X |
| 4,044,529 | 8/1977 | Zelnick | 53/556 X |
| 4,413,463 | 11/1983 | Lancaster | 53/556 X |

*Primary Examiner*—John Sipos

*Attorney, Agent, or Firm*—Mason, Fenwick & Lawrence

[57] ABSTRACT

A process for wrapping a load with prestretched film comprising unwinding and prestretching the film before applying the film to the load, passing the load through a curtain of film and cutting the film behind the load while forming the curtain and wherein said prestretching step includes positioning the prestretching means in a standby position in front of the load wherein said means are positioned close together while initially prestretching the curtain, moving the prestretching means apart transversely in association with the required delivery of the prestretched film until such means are in a spaced apart position near the side surfaces of the load, prestretching the film to cover the side surfaces of the load, prestretching the film to cover the rear surface of the load, and then moving the prestretching means toward one another transversely behind the load until they are close together in association with the necessary delivery of prestretched film.

16 Claims, 8 Drawing Sheets

PROCESS AND APPARATUS FOR PASS-THROUGH WRAPPING

The invention relates to a process and an apparatus for pass-through wrapping using pre-stretched stretchable film.

BACKGROUND OF THE INVENTION

Processes and apparatus of this kind are of use for wrapping palletized loads on their vertical front, side and rear surfaces. A vertical transverse film curtain which extends before the front surface of the load from two film reels having stationary vertical spindles and disposed on either side of a powered conveyor carrying the load, is first produced by means of a transverse weld. The load moves towards the curtain. The curtain is deformed transversely substantially into a substantially U-shaped contour to cover the front and side surfaces of the load. The same stops when it has passed the reels. The curtain is deformed transversely on either side of the load to apply the film to the rear surface so as to be closed on itself. By means of cutting and welding jaws the curtain is cut and double-welded transversely to disconnect the wrapped load from the film coming off the reels and to restore a film curtain for a subsequent wrapping cycle for another load.

PRIOR ART

These processes and apparatus were originally used with heat-shrinkable films, the actual wrapping step being followed by a heat-shrinking step by means of an oven or the like (FR-P No. 2 212 263, U.S. Pat. Nos. 3,514,920, 3,640,048 and 3,662,512).

The processes and apparatuses were subsequently used with stretchable films. In the original technology (FR-P No. 2 243 113, U.S. Pat. No. 3,672,116, U.S. Pat. No. 4,044,529) stretching is produced by braking of the film reels. In a second technology, originally disclosed in FR-P No. 2 281 275, the film is pre-stretched, being stretched by means of pre-stretching means before being applied to the load and independently thereof. The pre-stretching means take the form, for example, of two rollers, the downstream roller running faster than the upstream roller (as referred to the direction of film movement). In one construction using powered pre-stretching the two rollers are associated with one another by gears and are driven positively by a motor.

U.S. Pat. No. 4,413,463 discloses a development of the pass-through wrapping process with powered pre-stretching; the latter patent provides a roller having a spring-biased floating spindle and operative as a detector of the force exerted by the film, the detector being carried by the load and controlling the motor of the pre-stretching means, clamping shoes ensuring that the transverse cutting and welding steps are not carried out on the tensioned film, in contrast to U.S. Pat. No. 3,672,116.

FR-P No. 2 568 219 discloses another development wherein the apparatus has a pre-stretching system with speed-gradient rollers. The stated aim is to produce substantially uniform tension of the film around the load and the proposed technology is the presence of transversely moving jaws behind the load, combined with means for driving the film at an appropriate speed relatively to the speed of the jaws. However, this aim is not attainable for all the film around the front, side and rear surfaces of the load since the stretched film is applied thereto after a time varying with the pre-stretching, the time being long for the front surface and decreasing to the shortest time for the rear surface. The stretched film is therefore not applied to the load in the resilient return or restoration phase which immediately follows the pre-stretching phase. Also, the length of pre-stretched film varies considerably before application to the load and the film is welded while in the stretched state, an unsatisfactory state of affairs.

Pass-through pre-stretch wrapping machines have some advantages, particularly automatic operation, but present problems limiting their use.

The first problem is to ensure that the clamping force exerted by the film on load is as constant as possible on the various load surfaces. Merely controlling pre-stretching by the detected force of the film is not enough to achieve an adequately constant clamping force (U.S. Pat. No. 4,413,463). Similarly, action on the film during the covering of the rear surface does not lead to action on the entire film around the load (FR-P No. 2 568 219).

The second problem is the ability for a single apparatus to be convenient to use to wrap loads of different heights—i.e., different distances between the top surface and bottom surface of the load—or different widths or to strengthen the wrapping locally, more particularly in the mid-part of load height.

The third problem is the possibility of laying on the top surface of the load a plastics top sheet with the same apparatus and in a convenient manner, mainly for loads of different heights.

THE INVENTION

It is therefore a main object of the invention to solve these problems and more generally to propose a process and apparatus for pass-through wrapping, with pre-stretching of the stretchable film, which are distinguished by the quality of wrapping they can provide, by their automatic operation features and by their versatility.

In a pass-through pre-stretch wrapping process according to the invention, the time between pre-stretching of the film and the application thereof to the load is short and varies very little during a wrapping cycle, so that the film is applied to the load in the elastic restoration or return phase which immediately follows the pre-stretching phase; and the length of pre-stretched film before application of the film to the load is reduced and varies very little during a wrapping cycle. These two features are operative for all the film associated with the front, side and rear surfaces of the load.

According to another feature of the invention, the pre-stretching means are maintained near, more particularly very near, the load surface to which the stretched film is being applied. Also, the delivery speed of the pre-stretched film is so controlled by the position of the load relatively to the pre-stretching means that the clamping forces exerted by the film on the various surfaces of the load are either equal or very similar to one another.

According to another feature of a pass-through wrapping process according to the invention, the load is wrapped in two consecutive passes, in the first of which the film is contiguous with or near the bottom surface of the load and in the second of which the film is contiguous with or near the top surface of the load.

In a pass-through wrapping apparatus according to the invention, its two pre-stretching means are movable transversely between two end positions—a spaced-apart position in which the load can pass between them, and a close-together position in which they are near one another. An apparatus of this kind can also comprise two slides which support the cutting and welding jaws and the pre-stretching means, and two respective guide rollers over which the film moves, the roller spindles and, therefore, the rollers themselves being movable between two end positions, namely an operative projecting position and a retracted position, the rollers being operative when in their operative projecting position to prevent the film from rubbing on the jaws and in changing over from the operative projecting position to the retracted position (in which the slides are close together) to slacken the film for transverse welding.

According to another feature, the apparatus can comprise two film-laying units, namely a bottom unit and a top unit, and possibly integrated means for laying a plastics top sheet or foil on the top surface of the load.

The inventor has discovered first that the ability to provide a quality wrapping, more particularly with a film exerting a clamping force varying little, if at all, on the various load surfaces is linked not only with control of pre-stretching, as is known, but also and mainly with the conditions in which the stretched film is applied to the load. Immediately after stretching the released film tends to experience a substantial reduction in its clamping force simultaneously as its stretch decreases slightly (elastic phase of the hysteresis cycle). The inventor therefore developed the general notion that control of pre-stretching had to be combined with the pre-stretched film being applied to the load as soon as possible after pre-stretching and within a time remaining as constant as possible throughout a wrapping cycle. The inventor also developed the particular idea that control responsive to the position of the load relatively to the pre-stretching means was preferable to the known system of controlling pre-stretching in dependence upon the force applied by the film.

The inventor also showed that in the case of a very high load two curtains of relatively reduced width overlapping in the mid-part of load height were preferable to a single film curtain of substantial width.

These characteristics disclosed by the inventor are contrary to the teachings of U.S. Pat. No. 4,413,463 in which the length of pre-stretched film before application to the load is always considerable and varies considerable in a wrapping cycle. More particularly, because of the layout of the apparatus the length of pre-stretched film between the pre-stretching means is greatest when the film is being applied to the load rear surface. Also and consequently, the time between pre-stretching of the film and application thereof to the load is considerable and also varies considerably in a wrapping cycle. This is due inter alia to the presence of the film force sensing rollers, of deflecting rollers separating the film from the side surfaces of the load, to the length of the pre-stretched film and, as previously stated, in the light of the position of the pre-stretching means relatively to the load.

These characteristics are also contrary to the teachings of FR-P No. 2 568 219, the subject of which is actually limited to the problem of covering the rear surface of the load, since the same is stationary during this step.

DESCRIPTION OF PREFERRED EMBODIMENTS

Other characteristics and advantages of the invention will become apparent from the following description, reference being made to the accompanying drawings wherein.

Figure 1:
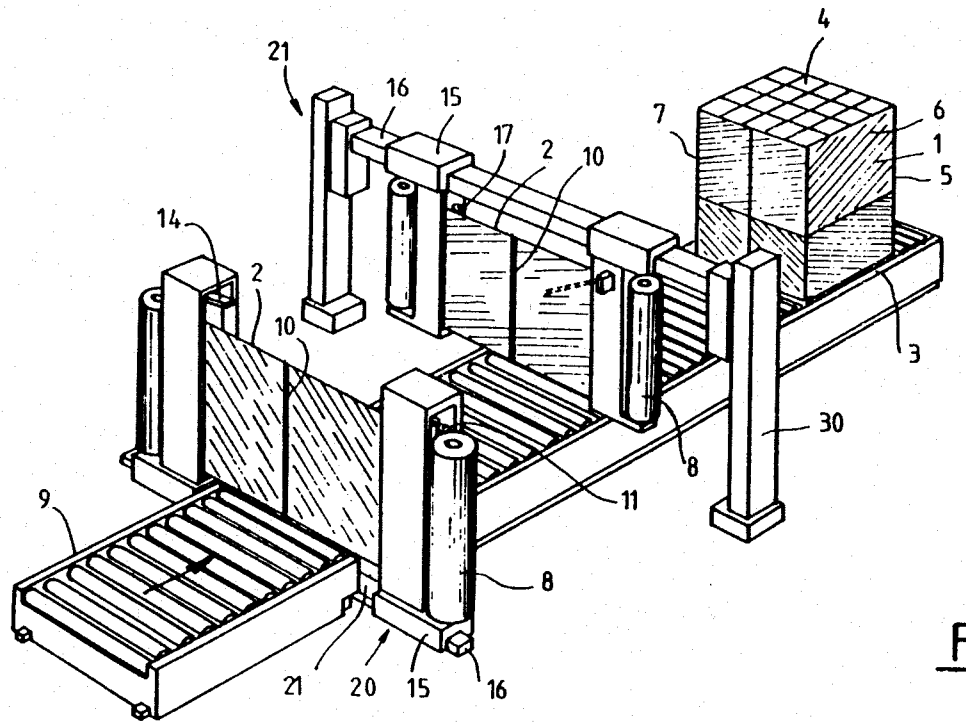
FIG. 1 is a diagrammatic perspective view of one possible embodiment of an apparatus according to the invention, the various elements thereof being shown in an inoperative theoretical position for the sake of a clearer understanding.

The invention relates to a process and apparatus for pass-through wrapping of a load 1, particularly a palletized load, in a stretchable plastics film 2 using pre-stretching.

The load 1 has a parallelepipedic shape bounded by a horizontal bottom surface 3, a horizontal top surface 4, a vertical front surface 5, two vertical side surfaces 6 and a vertical rear surface 7.

The load 1 can be indivisible or consist of a number of elementary loads, the film 2 being operative to hold the load 1 together and protect it against weathering. The use of pre-stretching makes it possible to wrap loads 1 which are fragile or not cohesive or which have irregular or cutting shapes.

The film 2 is stretchable—i.e. it can be elongated by several tens and hundreds percent by a stretching force, relaxed with time, experience a resilient phase of the hysteresis cycle following its elongation, possibly experience a visco-elastic phase following the elastic phase or, if the film is kept elongated during the resilient phase, produce an increased clamping force. Films of this kind are commercially available, inter alia by the Mobile and Exxon companies. According to the invention, the idea of applying the film 2 to the load 1 in its elastic phase is used in order to increase the clamping force after the film 2 has been placed on the load 1, the final aim being to produce a very constant and very substantial clamping force.

The first step is to produce by means of a transverse weld 10 an initial transverse curtain of film 2 before the front surface 5 from two film reels 8 disposed substantially symmetrically of a powered conveyor line 9 for the load 1; the same moves towards the film curtain 2 (from upstream to downstream); the curtain 2 is deformed transversely into a substantially U-shaped contour so as to cover the front surface 5 and side surfaces 6; the film 2 unwinds from the reels 8 and is simultaneously pre-stretched by means of two pre-stretching means 11 before being applied to the load so that the film 2 is applied thereto in the pre-stretched state; the load 1 stops after it has passed the reels 8; the curtain 2 is deformed transversely on either side of the load 1 to engage the film 2 with the rear surface 7, the film curtain 2 therefore being closed on itself; the film curtain 2 is cut and double-welded transversely, as indicated by the reference 10, in order to disconnect the wrapped load 1 from the film 2 coming off the reels 8 and restore an initial film curtain 2 for a subsequent wrapping cycle for another load 1.

The time between pre-stretching of the film 2 by the pre-stretching means 11 and the application of the pre-stretched film to the load 1 is short, more particularly very short, and varies very little in a complete wrapping cycle. The film 2 is therefore applied to the load 1 in the pre-stretched state during the resilient return or restoration phase immediately following the pre-stretching phase.

Accordingly, the length of pre-stretched film 2 before application to the load 1 is reduced, more particularly very reduced, and varies very little in a complete wrapping cycle.

The term "time between pre-stretching of the film 2 and its application to the load 1" denotes the time between the instant at which the film 2 passes the pre-stretching means 11 and the instant at which the film 2 is engaged with the load 1. This time is very short because the pre-stretching means 11 are very near the load 1 and the path of the film 2 between the means 11 and the load 1 is very direct and short.

For example, and without the values being limitative, such time (pre-stretching/application to the load 1) is of the order of a few seconds, notably 5 seconds, and the length of pre-stretched film before its application to the load 1 is of the order of 50 cm.

Also and in combination, stretching of the initial film curtain 2 proceeds immediately before application of the film to the front surface 5, unlike the prior art in which the initial film curtain standing by for an operating cycle has already been stretched or pre-stretched.

The pre-stretching means 11 are permanently maintained near, more particularly very near, the surface 5 or 6 or 7 to which the stretched film is being applied, unlike the prior art in which the pre-stretching means are stationary and/or at a distance from the load 1.

This characteristic is carried into effect in three different ways. In the first way, the pre-stretching means 11 are placed facing and very near the front surface 5 before the stretched film 2 is applied thereto. In the second way, the pre-stretching means 11 are placed facing, behind and very near the rear surface 7 at the time of applying the stretched film 2 thereto. In the third way, the pre-stretching means 11 are disposed facing and very near the side surfaces 6 at the time of applying the stretched film 2 thereto. The transverse mobility of the means 11 enables them to achieve this intimate closeness with any kind of load 1.

Also, the pre-stretched film 2 is applied directly to the load 1, notably without passing through storage means or film force detecting means. The invention therefore ensures that the path travelled by the film 2 between the means 11 and the load 1 is not complex, indirect and therefore excessive.

The stretched film 2 is applied to the load 1 in a very short time immediately after pre-stretching, the time being constant or varying very little, for example, by a few percent. At the time of application to the load 1 the stretched film 2 is in the resilient phase of the hysteresis loop following its stretching but near the stretching point, and so the clamping force which the film 2 exerts on the load 1 is increased.

Consequently, the clamping force exerted by the film 2 on the load 1 varies little as between the various load surfaces and pre-stretching is more efficient.

According to another feature, in given conditions (linear speed of movement of the load 1, characteristics of the film 2 and load 1 (dimensions, cohesion, fragility, cutting edges or not), the clamping force exerted by the film 2 on the load 1 after wrapping), the delivery speed of the pre-stretched film 2 delivered by the powered pre-stretching means 11 is so controlled by the position of the load 1 relatively to the pre-stretching means 11 that the clamping forces exerted by the film on the various surfaces 5, 6, 7 of the load 1 are either equal or very similar to one another. This control is preferable to control by the force of the film.

To this end, set values for the pre-stretched film delivery speed in phases of the cycle are defined, viz. a first value $V_1$ for a first phase in which the initial film curtain 2 is pre-stretched, a final value $V_4$ for the phase in which the pre-stretched film 2 is applied to the rear surface 7 of the load, and at least one intermediate value $V_2$ in the phase in which the pre-stretched film 2 is applied to the side surfaces 6.

Preferably, at least two intermediate set values $V_2$ and $V_3$ corresponding more particularly to the start and more particularly to the finish, respectively, of the application of the pre-stretched film 2 to the lateral surfaces 6 are defined.

The set values $V_1$, $V_2$, $V_3$ and and $V_4$ are calculated in dependence upon the geometry of the system formed by the load 1 and means 11 and upon the general conditions in which the process operates.

The set values $V_1$, $V_2$, $V_3$, $V_4$ take into consideration the fact that in the first phase of the cycle the pre-stretched film delivery speed may be constant. Similar considerations apply in the phase in which the pre-stretched film 2 is being applied to the rear surface 7. With regard to the side surfaces 6, the invention proposes a compromise with the determination of two set values corresponding to two extreme positions of the load 1 relatively to the means 11. Clearly, however, the invention could also operate with just a single intermediate set value $V_2$ or with a greater number of intermediate set values. In the former case the clamping force will be less constant and in the latter case it will be more constant.

The user can define one of the set values, for example, the first set value $V_1$, and the other values $V_2$, $V_3$, $V_4$ are determined consequentially. The determination and use of the set values $V_1$, $V_2$, $V_3$, $V_4$ help to control the pre-stretching means 11 without any need to measure the actual force of the film.

The carrying of the process into effect may imply a location of the position of the load 1 relatively to the pre-stretching means 11 and, more particularly, a location of the position of the front surface 5 and rear surface 7 so as to control the speed of the motor of the means 11. As a rule, the linear speed of movement of the moving load 1 is constant.

Figure 2A:
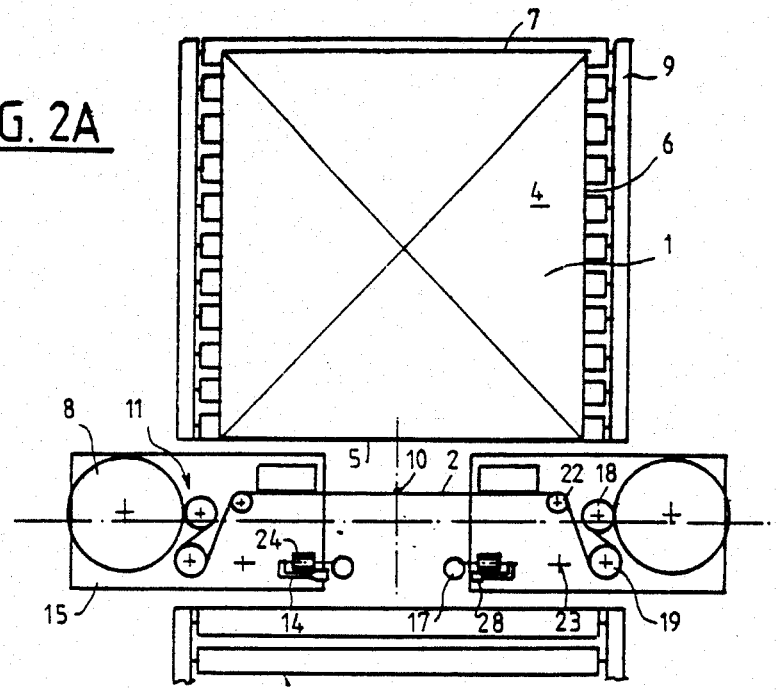
FIGS. 2A, 2B, 2C, 2D, 2E, 2F and 2G are seven diagrammatic plan views showing the various stages of the process according to the invention for one pass of film.
Figure 2B:
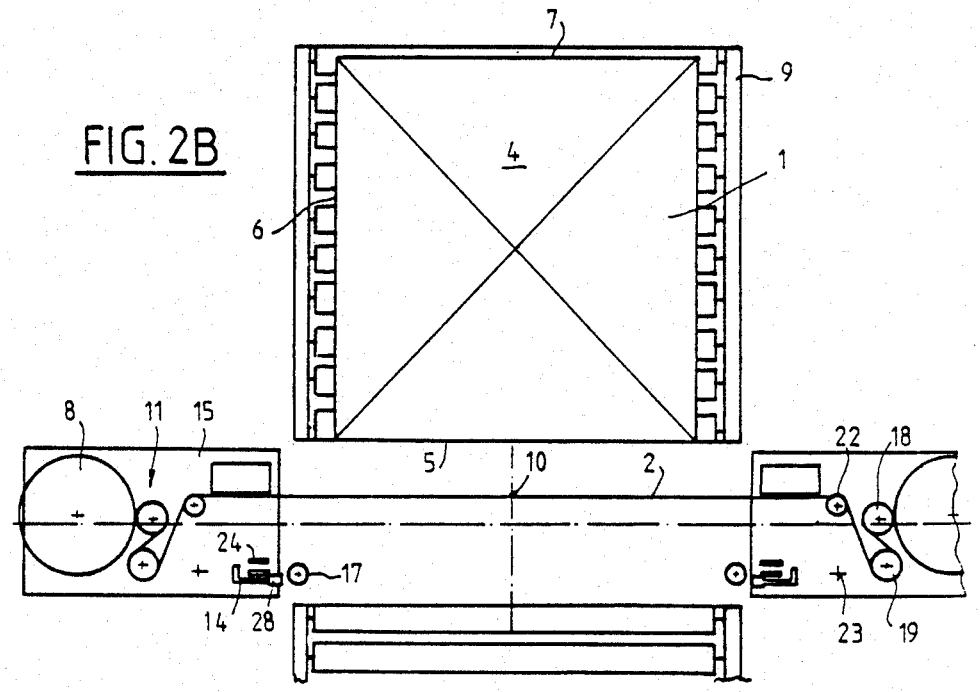

The process starts from an initial position which is shown in FIG. 2A and which is a standby position and in which the two pre-stretching means 11 are close together, more particularly near the load track 9. The film curtain 2 between the means 11 is in the unstretched state. The load 1 is disposed opposite the film 2 and the means 11, the load front surface 5 facing and being very near the film 2 and means 11. Then and only then, as can be seen in FIG. 2B, the step of initial prestretching of the film curtain 2 is carried out, to which end the two means 11 move apart from one another transversely in association with the required delivery of pre-stretched film. The transverse separating movement of the means 11 continues as far as a spaced-apart position in which the means 11 are near the side surfaces 6 while allowing the load 1 to pass between them. As a rule, the transverse separating movement of the means 11 proceeds at a constant linear speed to which there corresponds a set value $V_1$ of the delivery of pre-stretched film by the powered means 11. The load 1 remains stationary while the means 11 move apart from one another in this step.

Figure 2C:
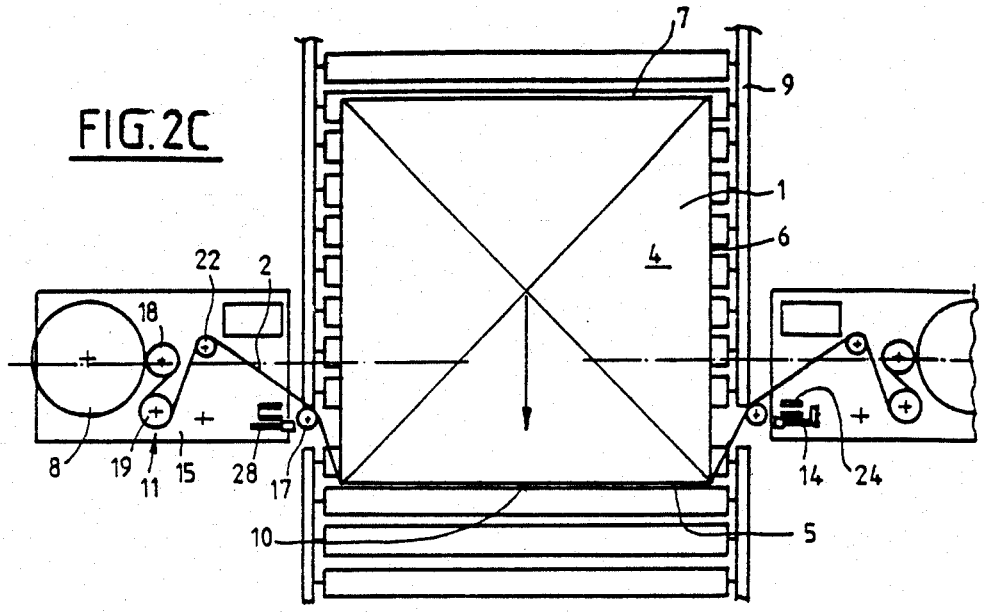
Figure 2D:
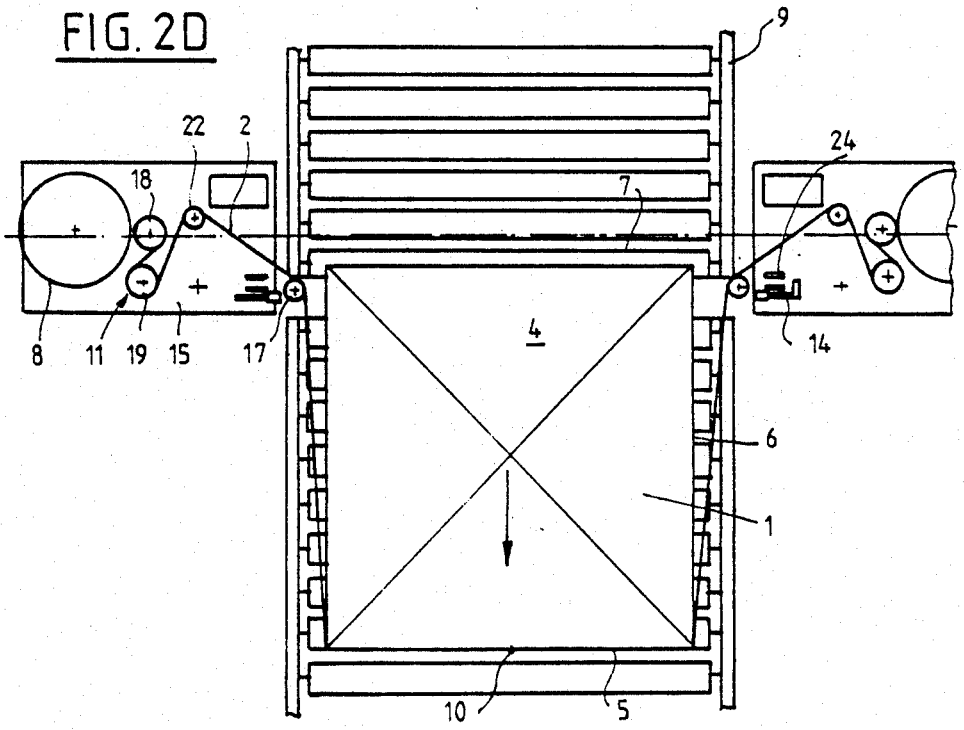

Thereafter, and as shown in FIGS. 2C and 2D, the load 1 moves downstream, more particularly at a constant linear speed, and the film 2 is pre-stretched for engagement on the side surfaces 6, first in the region immediately adjacent the front surface 5 and then in the zone immediately adjacent the rear surface 7. As previously stated, it is preferred to determine two set values $V_2$, $V_3$ for these two cases. Also, the pre-stretched film 2 issuing from the pre-stretching means 11 is preferably deformed in order to be engaged on the load 1, inter alia by means of guide rollers to be described hereinafter.

Figure 2E:
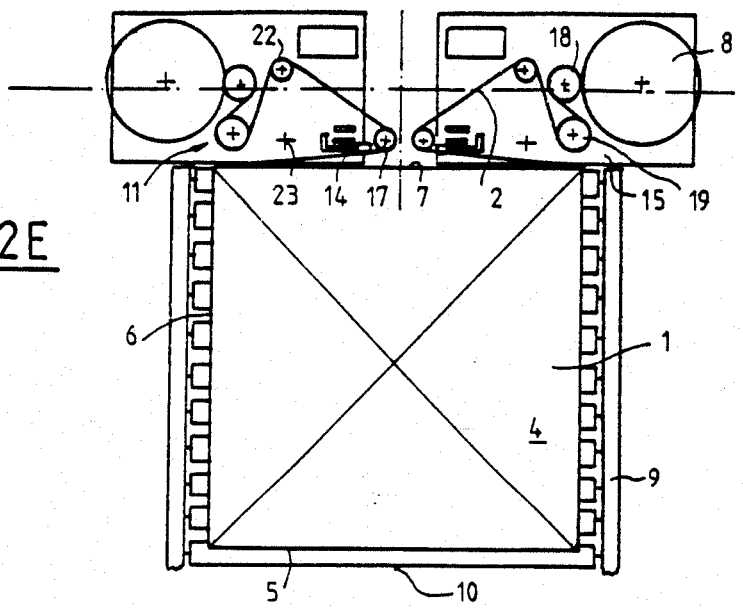
Figure 2F:
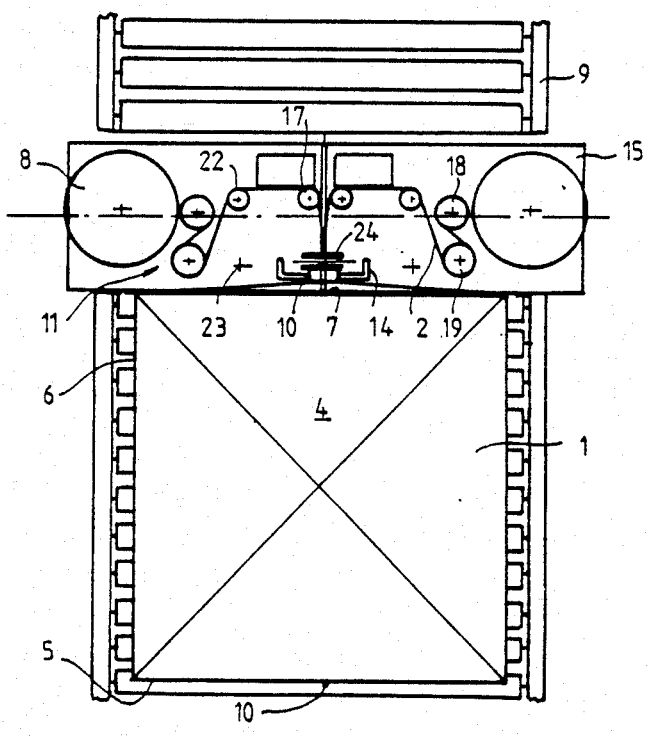

Thereafter, and as shown in FIGS. 2E and 2F, the load 1 has passed the reels 8 and come to a standstill. With the load 1 in this position the film 2 is pre-stretched for the rear surface 7, to which end the two means 11 move towards one another transversely until they are in a close-together position in association with the necessary delivery of pre-stretched film, in dependence upon the final set value $V_4$.

The means 11 are further apart from one another in the standby position of FIG. 2A than in the close-together position of FIG. 2E.

Figure 2G:
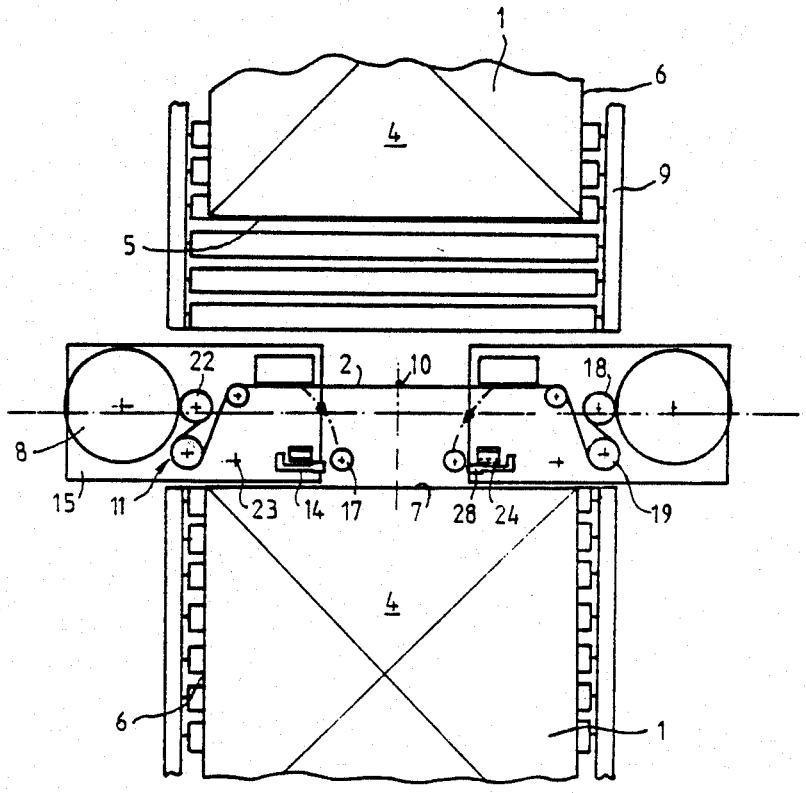

Once the means 11 are in the close-together position of FIG. 2E the film curtain 2 is welded transversely, as shown in FIG. 2F, immediately after pre-stretching and after slackening of the film (FIGS. 2E and 2F), whereafter the standby position is returned too (FIG. 2G).

Carrying out the transverse welding immediately after pre-stretching is the result more particularly of the fact that the pre-stretching means 11 are close together so that the film length between the means 11 and the weld 10 is very reduced.

In a variant, the film curtain 2 is applied in contiguity with or near the load top surface 4 and the same has laid on it a plastics top sheet or foil 12, the skirts or drops 13 of which drop on the surfaces 5–7.

The sheet 12 is a sheet or foil made of ordinary or stretchable or heat-shrinkable plastics. As a rule, the top sheet 12 plays no part in holding the load together but is operative solely to protect the load against weathering.

The positioning of the top sheet 12 proceeds more particularly as follows: the front drop or skirt 13 of the top sheet 12 is first placed on the front surface 5, whereafter the film curtain 2 is applied to the front surface 5 and above the front skirt 13 so as to trap the same strongly. Thereafter first the skirts 13 and then the film curtain 2 are applied progressively to the side surfaces 6. Finally first the rear skirt 13 and then the film curtain 2 are placed on the rear surface 7.

The positioning of the top sheet or foil 12 therefore proceeds simulaneously with or, more accurately, slightly before, the positioning of the film curtain around the load 1 so that the skirts 13 of the top sheet 12 can be trapped by the curtain 2 immediately after positioning.

The invention also relates to a pass-through process for wrapping a load 1 in which an initial transverse film curtain 2 is formed before the front surface 5, the load 1 moves towards the curtain 2, the same is deformed to cover the front surface 5 and side surface 6 of the load 1, the load 1 stops, the film curtain 2 is deformed transversely to engage the film 2 with the rear surface 7 of the load 1, the film 2 is cut and double-welded transversely, and the load 1 is wrapped in two consecutive and separate passes, one in which the film 2 is contiguous with or near the bottom surface 3 of the load 1 and the other in which the film 2 is contiguous with or near the top surface 4.

To this end, two films 2 each of a width less than the height of the load 1 between the top surface 3 and bottom surface 4 are used, the sum of the two widths being greater than the height of the load 1 so that the two films overlap, notably in the mid-part of load height.

Preferably, first the film contiguous with the bottom surface 3 and then, more particularly soon thereafter, the film contiguous with the top surface 4 are positioned, two films of the same widths and same characteristics being used.

One particular application of this process uses a stretchable film 2 and the load 1 is wrapped with prestressing of the stretchable film for each pass by the process hereinbefore described.

The general advantage of this two-pass process is that the process and apparatus have great versatility to deal with loads 1 of different heights. The two-pass process with pre-stretching has the further advantages of avoiding the use of films which are too wide for very high loads 1 and of enabling the clamping to be reinforced in the central zone.

The invention also relates to an apparatus for pass-through wrapping of a load 1 with pre-stretching of the stretchable film 2, of use more particularly for carrying out the process hereinbefore described, the apparatus comprising: a powered conveyor adapted to carry the load 1 and defining a movement track therefor, the conveyor being disposed substantially horizontally and being more particularly a roller conveyor; and a unit for placing pre-stretched film 2 on the load 1 and comprising two reel supports whose axes are substantially vertical and which are symmetrical of the conveyor 9; two pre-stretching means 11 extending parallel to the reels 8 and also symmetrical of the conveyor 9; two jaws 14 for cutting and transverse welding of the film 2, the jaws also extending parallel to the reels 8 and being disposed symmetrically of the conveyor 9 and being movable between two end positions—a spaced-apart position in which the load 1 can pass between them, and a close-together position in which they engage one another.

The two pre-stretching means 11 are adapted to move transversely between two end positions—a spaced-apart position, in which the load can pass between them, and a close position in which they are near one another.

The pre-stretching means 11 can also be in an intermediate or standby position which is between the spaced-apart and close-together end positions and in which they are very close to one another.

Preferably, the apparatus comprises: two slides 15 slidable on a transverse and more particularly horizontal support guide 16, the slides supporting one each the two cutting and welding jaws 14 and the two prestretching means 11 very near one another in the transverse and longitudinal direction, respectively. The apparatus also comprises slide-driving means and means for controlling the slide-driving means (not shown). The two slides are movable between two end positions, one in which they are separated from one another and one in which they are close together, the two end positions corresponding to the two end positions of the pre-stretching means 11 and jaws 14.

The means for controlling the slide-driving means are so triggered in dependence upon the operation of the conveyor 9 in given working conditions that in an initial position of a cycle the conveyor 9 is stationary and the two slides 15 are near one another in a standby position but further apart than in the close-together position. In the standby position the film 2 between the two pre-stretching means 11 is not stretched (FIG. 2A). Thereafter (FIG. 2B) the slides 15 move into the spaced-apart position so that the initial pre-stretching step of the film curtain 2 can be carried out, the conveyor 9 remaining stationary. Thereafter, and as shown in FIGS. 2C and 2D, the slides 15 remain in their spaced-apart position while the conveyor 9 operates so that the film curtain 2 envelopes the load 1 as described with reference to the operation of the process. Once the load 1 has passed beyond the reels 8 the conveyor 9 stops and the slides 15 move into the close-together position shown in FIGS. 2E and 2F, in which position the jaws 14 can be engaged with one another and carry out the required cutting and welding steps 10, the pre-stretching means 11 also being very close together.

The slides 15 also support the two reel supports relatively, the pre-stretching means 11 possibly being positioned very near the reels 8 and overall in a fixed position relatively to the reels 8.

In another embodiment the spindles of the reels 8 are fixedly disposed on either side of the conveyor 9 and the distance between the reels 8 and the means 11 decreases or increases according as the slides 15 are in their spaced-apart or close-together position.

The two slides 15 also each support one of two guide rollers 17 over which the film 2 passes after the pre-stretching means 11, the rollers 17 extending parallel to the reels 8 and being freely pivotable around their spindles, the same and therefore the rollers 17 being movable as a whole between two end positions—an operative projecting position (FIGS. 2C, 2D, 2E) and a retracted position (FIG. 2F). When in their operative projecting position the two rollers 17 are near and inside the two jaws 14 on the downstream side relatively to the direction of movement of the conveyor 9. When in the retracted position the rollers 17 are also coplanar with the two jaws 14 and on the upstream side.

The rollers 17 are operative when in their projecting position to prevent the film 2 from rubbing on the jaws 14, and in changing over from the projecting position to the retracted position, with the slides 15 close together, the rollers 17 are operative to slacken the film 2, bearing in mind that the length of the path between the means 11 and the jaws 14 is shorter with the rollers 17 in their retracted position than when they are in their operative projecting position.

In their operative projecting position and when the film 2 is being engaged with the side surfaces 6, the rollers 17 are disposed very near the side surfaces 6 and are also operative to deflect the film 2 to move the same towards the surfaces 6 and thus increase the speed at which the pre-stretched film 2 is engaged on the surfaces 6.

The presence of slides 15 supporting the means 11, jaws 14, rollers 17 and, where applicable, reels 8 further enables the apparatus to be used with loads 1 of different sizes, the apparatus always remaining adapted to the load 1, inter alia the means 11 remaining at a constant and known distance from the side surfaces 6.

Preferably, the pre-stretching means 11 are powered, each comprising, for example, an upstream roller 18 and a downstream roller 19 interconnected inter alia by gears so that the downstream roller 19 runs faster than the upstream roller 18. A pre-stretching system of this kind comprising two powered rollers running at different speeds is known and inter alia described in a general way in the Applicant's FR-P No. 2 281 275.

The drive means for the means 11 defining the delivery speed of stretched film are controlled, in given conditions of use, by the conveyor 9 and by the position of the load 1 on the conveyor 9 relatively to the means 11, so that the clamping forces which the film 2 exerts on the various faces 5, 6, 7 of the load are all equal or very similar to one another. Preferably, however, this control does not require the use of a film force detector or the like disturbing the operation of the apparatus and lengthening the path of the pre-stretched film 2.

In one embodiment the apparatus comprises a bottom unit 20 for placing pre-stretched film 2 on the bottom part of the load 1, inter alia the part contiguous with the bottom surface 3, and the means 11, jaws 14 and rollers 17 extend downwardly at least as far as the plane of the conveyor 9 and preferably even lower than such plane by extending transversely through the conveyor 9. In this event the support guide 16 of the bottom unit 20 is preferably disposed below the conveyor 9. The longitudinal extent of the slides 15, as considered in the direction of movement of the load 1 on the conveyor 9, is of the same order of magnitude as the diameter of the reels 8. This longitudinal parameter is that of all the moving elements associated with the film—i.e., jaws, reels and pre-stretching means. Also, the conveyor 9 has a transverse passage 21 through which the means 11, jaws 14, rollers 17 and, if necessary, the slides 8 and reels 8 can extend.

This constructional arrangement is possible because the longitudinal extent of the bottom unit 20 is very limited since the film 2 moves along a direct circuit free from tortuous paths extending longitudinally from front to rear or the converse. Consequently, the load 1 can pass through the passage 21 readily and with the necessary stability.

In the embodiment in which the slides 15 support the reels 8, as shown in FIGS. 2A to 2G, a slide 15 has in elevation—i.e. seen in plan—a substantially rectangular shape. The reel 8 is disposed at the outer end part. Disposed very near the reel 8 are the means 11, the two rollers 18, 19 being offset lengthwise for reasons of space. A roller 22 deflects the film 2 in the upstream direction. The jaw 14 is disposed at the bottom inside part and in the downstream direction. Also disposed on the slide is the roller 17, the same being carried at the end part of a lever pivotable around a spindle 23 disposed on the slide 15 of the downstream side towards the outside of the jaws 14 between the same and the downstream roller 19.

Figure 3A:
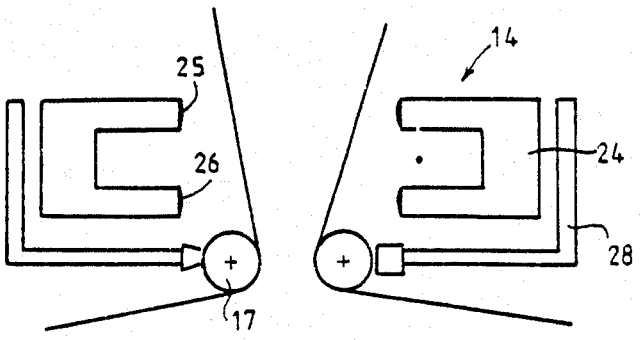
FIGS. 3A, 3B and 3C are three diagrammatic view in cross-section showing the transverse cutting and welding jaws.

Each jaw 14 (FIGS. 3A to 3C) comprises a U-shaped member 24 having two transverse arms 25, 26 spaced apart from one another lengthwise. The two arms 25, 26 co-operate with the arms of the facing jaws 14 to form the welding jaws and enable two transverse welds spaced apart from one another longitudinally to be carried out. Disposed in a gap between the two arms 25, 26 of one of the members 24 is a cutting hot wire 27 adapted to be moved transversely by appropriate drive means so as to move from one of the members 24 to the other in order to cut the film 2 transversely between the two welds.

Also, the jaws 14 comprise immediately downstream of the members 24 a clamp 28 adapted to clamp the film downstream of the members 24 so that downstream of the clamp 28 the film is stretched against the rear surface 7 of the load whereas upstream of the clamp 28 the film 2 can be slackened for welding.

Figure 3B:
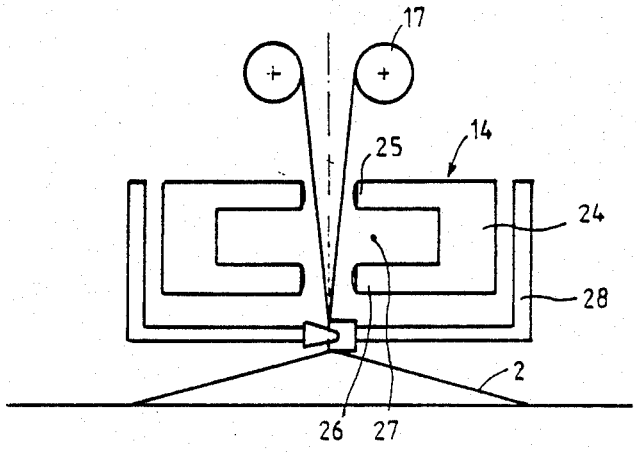
Figure 3C:
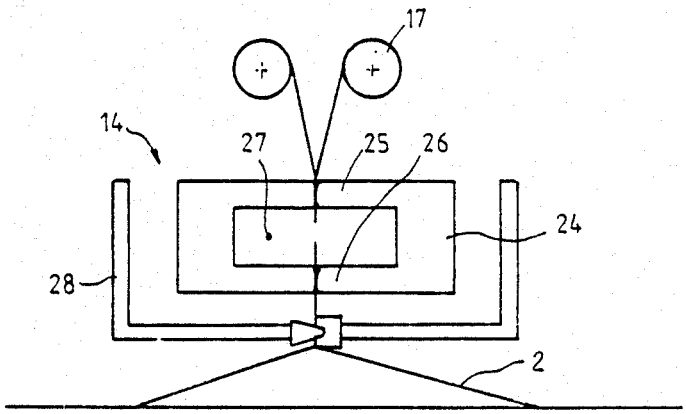
Figure 4A:
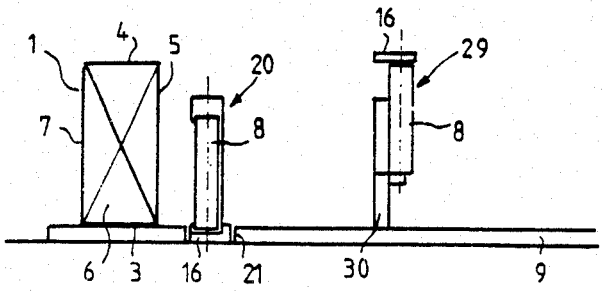
FIGS. 4A, 4B, 4C, 4D and 4E are five diagrammatic side views showing the various stages of a two-pass process according to the invention with the use of the apparatus shown in FIG. 1.
Figure 4B:
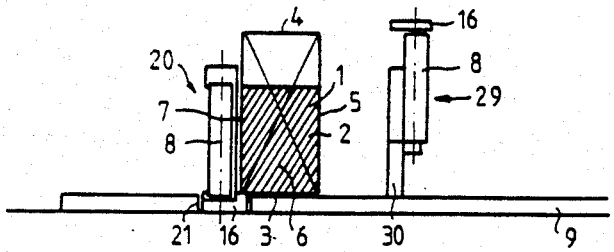
Figure 4C:
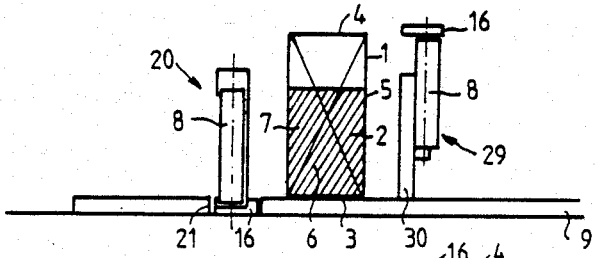
Figure 4D:
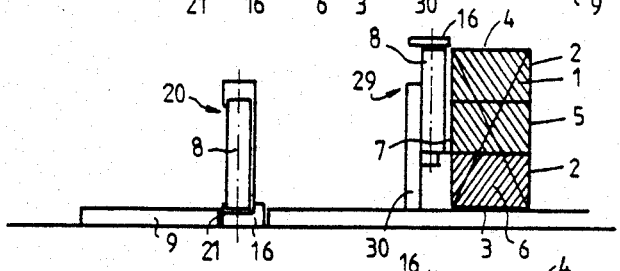
Figure 4E:
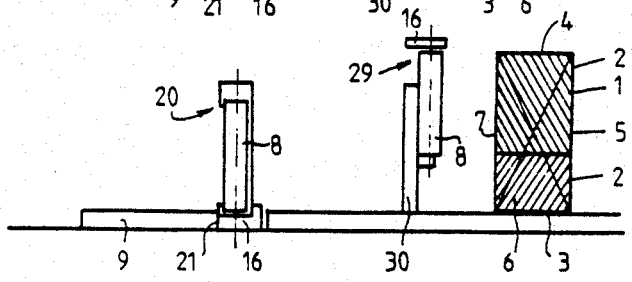
Figure 5:
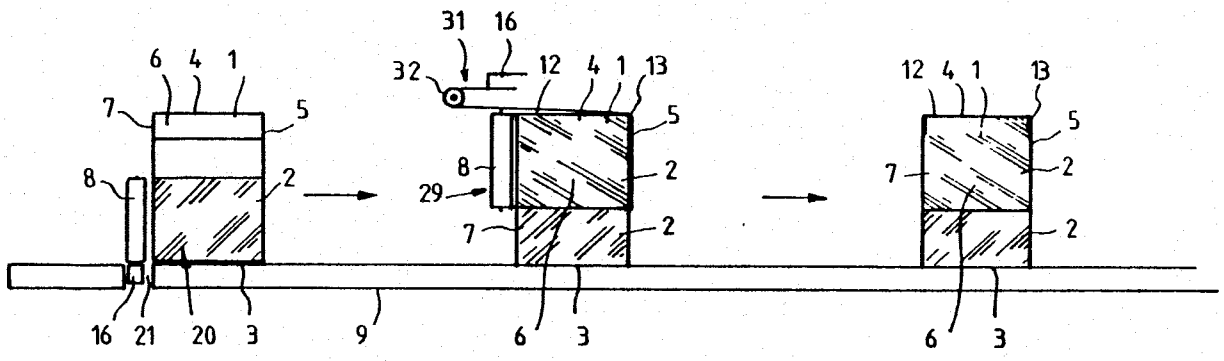
FIG. 5 is a diagrammatic side view showing the variant in which a top sheet or foil is placed on the load.

The two parts of the clamp 28 can be permanently biased by a spring or the like towards a position in which they project from the members 24, as shown in FIG. 3B, and be retracted, while remaining in engagement with one another, when the two members 24 are engaged with one another, as shown in FIG. 3C, in which position they are coplanar with the members 24.

The clamp 28 is combined operatively with the rollers 17 which when in their projecting position project beyond the two parts of the clamp 28.

The apparatus can comprise a top unit 29 for laying pre-stretched film on the top part of the load 2, inter alia contiguously with the top surface 4. The means 11, jaws 14 and rollers 17 extend upwardly as far as the plane of the top surface 4 of the load 1.

The support guide 16 for the top unit 29 is disposed above the conveyor 9 and load 1 and is slidable vertically and adjustably and accordingly carried by two support and guiding brackets 30 disposed substantially vertical on either side of the conveyor 9, drive means (not shown) for driving the support guide 16 being associated with the brackets 30.

The bottom unit 20 and top unit 29 are spaced apart lengthwise along the conveyor 9 by a distance at least equal to the distance between the front load surface 5 and rear load surface 7. The brackets 30 may possibly be arranged for longitudinal adjustment so that the latter distance can be adjusted.

The top unit 29 has the same general characteristics as the bottom unit 20 hereinbefore described, the reels 8 and the associated moving elements of the bottom unit 20 extending upwardly whereas the reels 8 and the associated moving elements of the top unit 29 extend downwardly.

The movements of the two units 20, 29 are of course co-ordinated. To this end, the means 11 of the top unit 9 are in their standby position when the load 1 has passed the bottom unit 20 and the film thereof is being engaged on the load rear surface 7.

In other respects, the two units 20, 29 have the same general structure and operate identically.

Because of this construction of the apparatus, loads of different heights can be wrapped without the film reels having to be changed. This arrangement is very important when considered in combination with the fact that the pre-stretching means 11 can also have their transverse spacing adjusted. The construction also makes it possible to provide a reinforced clamping strip in the mid-part of the height of a load 1 and obviates the need to use of film of excessive width, something which is not desirable in the case of pre-stretched stretchable film.

The apparatus can comprise integrated means 31 for placing on the top load surface 4 a plastics top sheet 12, the means comprising a film reel support 32 having a substantially horizontal axis and being transverse at the top, and means for cutting the film 32 transversely. Preferably, the means 31 are carried by the support guide 16 on the upstream side. This construction makes it possible to combine the operation of laying the top sheet 12 with the laying or placing of the film curtain contiguous with the top surface 4, inter alia the adjustment of the height of the means 31.

We claim:

1. A process for pass-through wrapping a load with prestretched stretchable film comprising the steps of:

forming an initial curtain of film;

moving theretowards a load having front, rear and side surfaces;

deforming the curtain to cover the front surface and side surfaces of the load;

unwinding the film from reels and simultaneously prestretching said film by a plurality of prestretching means before being applied to the load so that the film is applied thereto in a prestretched state;

stopping the movement of the load;

deforming the curtain to engage it with the rear surface of the load; and then cutting and double-welding the curtain transversely;

positioning a prestretching means in front of the front surface of the load before application of the prestretched film thereto and positioning another prestretching means near and behind the rear surface of the load when the prestretched film is being applied thereto;

whereby the prestretching means are maintained near the load surface to which the stretched film is being applied.

2. A process for pass-through wrapping a load with prestretched stretchable film comprising the steps of:

forming an initial curtain of film;

moving theretowards a load having front, rear and side surfaces;

deforming the curtain to cover the front surface and side surfaces of the load;

unwinding the film from reels and simultaneously prestretching said film by a plurality of prestretching means before applying said film to the load so that the film is applied thereto in a prestretched state;

stopping the movement of the load;

deforming the curtain to engage it with the rear surface of the load;

cutting and double-welding the curtain transversely;

wherein said prestretching step includes positioning the prestretching means in a standby position in front of the load wherein said means are positioned close together while initially prestretching the curtain, moving the prestretching means apart transversely in association with the required delivery of the prestretched film until such means are in a spaced apart position near the side surfaces of the load, prestretching the film to cover the side surfaces of the load, prestretching the film to cover the rear surface of the load, and then moving the prestretching means toward one another transversely behind the load until they are close together in association with the necessary delivery of prestretched film.

3. An apparatus for pass-through wrapping a load with prestretched stretchable film, comprising:

a powered conveyor means for carrying the load;

a means for laying prestretched film on the load, said means having film reels, and at least two supports for said reels;

a plurality of prestretching means positioned parallel to said reels and means for moving said prestretching means transversely between a spaced-apart position in which the load can pass between them, and a close-together position in which they are near one another in the path of the load over the conveyor means; and a plurality of cutting and welding jaws movable transversely between a spaced-apart position in which the load can pass between them, and a close-together position in which said jaws engage one another.

4. An apparatus according to claim 3 wherein said supports have axes that are substantially vertical.

5. An apparatus according to claim 3 further including a plurality of slides slidable on a transverse support guide for movement from a spaced-apart position to a close-together position, said slides being positioned for supporting said cutting and welding jaws and the prestretching means, and slide-driving means, and means for controlling said slide-driving means.

6. An apparatus according to claim 5, wherein said means for controlling said slide-driving means includes means for positioning said slides close together in a standby position, and for moving said slides in a spaced-apart position upon the operation of the conveyor, and for returning said slides back into their close-together position.

* * * * *